United States Patent [19]

McFarland

[11] Patent Number: 4,804,138

[45] Date of Patent: Feb. 14, 1989

[54] REINFORCED FLANGE TOP LIFTING CARTON

[75] Inventor: William W. McFarland, Cordova, Tenn.

[73] Assignee: International Paper Company, Purchase, N.Y.

[21] Appl. No.: 188,516

[22] Filed: Apr. 29, 1988

[51] Int. Cl.[4] ..... B65D 5/46

[52] U.S. Cl. ..... 229/171; 229/52 B; 229/199

[58] Field of Search ..... 229/145, 166, 171, 181, 229/199, 900, 52 B; 206/595, 596

[56] References Cited

U.S. PATENT DOCUMENTS

| | | | |
|---|---|---|---|
| 1,063,845 | 6/1913 | Weiss | 229/199 |
| 1,132,292 | 3/1915 | Weiss | 229/171 |
| 1,146,115 | 7/1915 | Weiss | 229/171 |
| 1,198,032 | 9/1916 | Henze | 229/145 |
| 1,527,021 | 2/1925 | Wandel | 229/199 |
| 2,474,523 | 6/1949 | Guyer | 229/43 |
| 2,623,682 | 12/1952 | Candell | 229/19 |
| 2,752,032 | 6/1956 | Fish | 206/7 |
| 2,990,996 | 7/1961 | Powlenko | 229/37 |
| 3,143,272 | 8/1964 | Webb et al. | 229/37 |
| 3,369,652 | 2/1968 | Bebout | 206/7 |
| 3,558,035 | 1/1971 | Stegner | 229/33 |
| 3,866,750 | 2/1975 | Collin | 229/52 B |
| 3,955,747 | 5/1976 | Bell | 229/37 E |
| 4,567,070 | 1/1986 | Karass | 229/199 |
| 4,580,718 | 4/1986 | Muise | 229/41 R |
| 4,718,597 | 1/1988 | Bishop | 229/199 |

*Primary Examiner*—Stephen Marcus
*Assistant Examiner*—Gary E. Elkins
*Attorney, Agent, or Firm*—Walt Thomas Zielinski

[57] ABSTRACT

A corrugated paperboard carton of the top lifting type and a unitary blank for forming it. The upper end of each sidewall is provided with a pair of flange panels, the latter folded upon themselves and glued together to form double thickness flanges extending around the upper rim of the carton, each positioned parallel to its respective sidewall. The free side edge of one flange panel carries a tongue received between next adjacent flange panels, the tongue glued in place. A flexible reinforcing strip is carried by one series of the pair of flange panels, the flexible strip extending from the tongue and across the flange panels. The ends of the reinforcing strip overlap, being separated by the thickness of the tongue. The carton is particularly useful in conjunction with lift trucks, the blades of such a truck being inserted between the flange panels and any corresponding sidewall for lifting the loaded carton.

11 Claims, 2 Drawing Sheets

FIG. 2
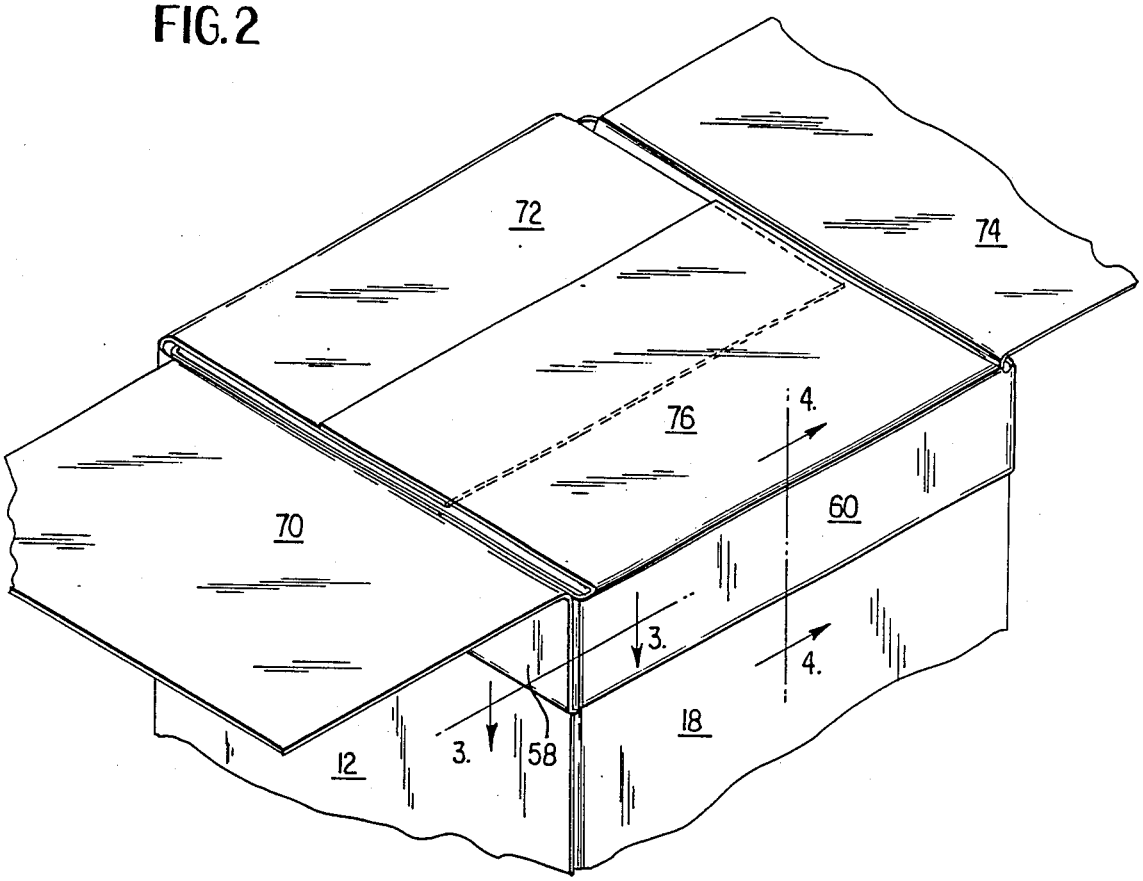
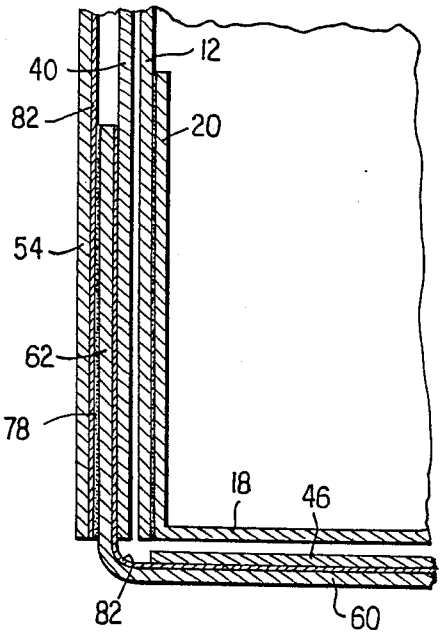
FIG. 3
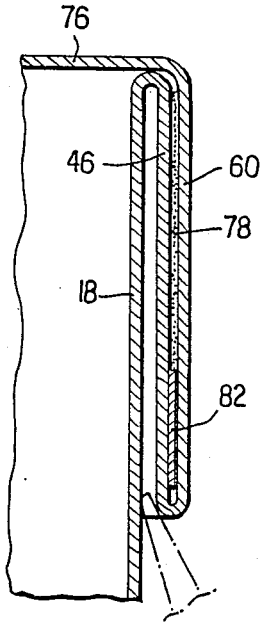
FIG. 4

REINFORCED FLANGE TOP LIFTING CARTON

BACKGROUND OF THE INVENTION

This invention relates to a top lifting carton particularly adopted for use with lift trucks, the carton having flanges around its top periphery, the flanges defining a space between them and a side of the carton to receive the blades of the lift truck. Such cartons are often formed from a single blank of corrugated paperboard, suitably scored, precut, folded and glued. After setting up, to form a tube, one end is closed, the carton is filled, and then the other end is closed. By virtue of the flanges around the upper periphery of such cartons, the blades of a lift truck can engage the carton to move it from its place of filling to a storage place or to a location for shipment.

Top lifting cartons of this type are known, as may be seen to reference to U.S. Pat. Nos. 2,474,523 issued to Guyer, 2,990,996 issued to Powlenko, and 3,143,272 issued to Webb et al. While apparently satisfactory for the purpose of a top lifting carton, the Powlenko and Webb constructions suffer the lack of a suitable reinforcing arrangement for the lift flanges. In Webb there is no means for reinforcing the flange, while in Powlenko a reinforcing band, denoted by the numeral 36, is placed around the outside of the flange members. This strap is said to be formed of an endless loop or as an alternative, a loop of wire or suitable pressure sensitive tape may be employed. From the nature of the Powlenko construction, even though it has a reinforcement for the flange members, the reinforcement must be applied only after the carton has been set up, filled and closed.

SUMMARY OF THE INVENTION

According to the practice of this invention, a top lifting carton, formed from a single blank of corrugated paperboard, is provided with a reinforcing tape. The construction is such that the tape is placed on the blank prior to the blank being set up or erected. Then, the blank is formed into a tube and can be collapsed for storage or for shipment. Later, when there is a requirement for use of the carton, the collapsed blank is opened, one end is closed, and the carton filled from the other end and then closed. Thus, unlike the Powlenko construction, one employing the present carton construction need not wait until the carton is filled before applying a reinforcing band. Further, the band is inside of the lift flanges and not exposed, as is the band of Powlenko. Such exposure carries with it the possibility of the band being dislodged or cut. Such dislodgement, particularly after the carton is filled and closed, would obviously render the reinforcing band of no use.

BRIEF DESCRIPTION OF THE DRAWINGS

FIG. 2 is a partial perspective view of the top portion of the carton of this ivnention just prior to closure of the top closure panels.

FIG. 3 is a view taken along Section 3—3 of FIG. 2.

FIG. 4 is a view taken along Section 4—4 of FIG. 2.

DETAILED DESCRIPTION OF THE INVENTION

Figure 1:
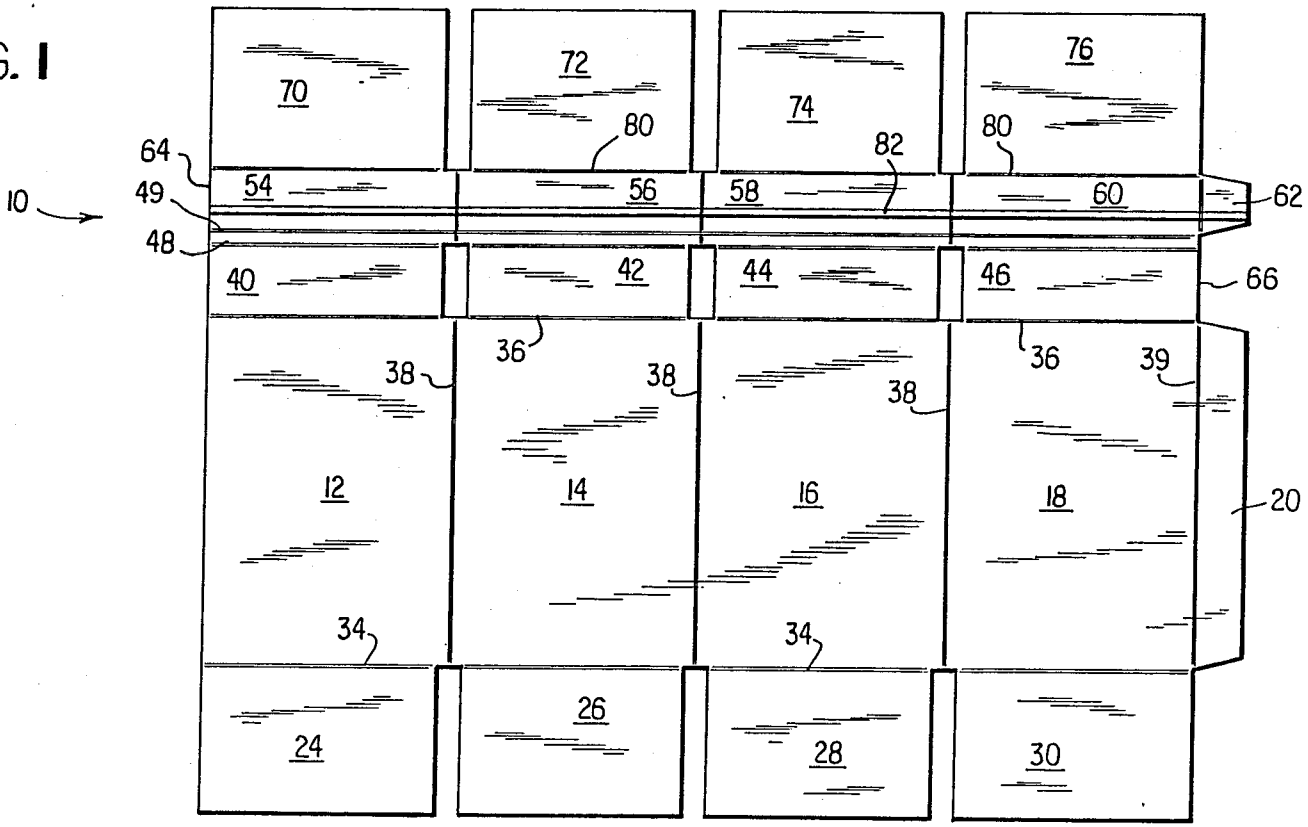
FIG. 1 is a plan view of a blank for forming the top lifting carton of this invention.

Referring now to FIG. 1 of the drawings, the numeral 10 denotes generally the one piece corrugated paperboard blank from which the top lifting carton of this invention is formed. The blank is generally of rectangular form and includes side panels 12, 14, 16 and 18, with the latter carrying a manufacturer's flap 20. Bottom closure panels 24, 26, 28, and 30 are connected, respectively, to these side panels through score lines 34 located at the bottom of each side panel. Score lines 36 are located at the top of each side panel, with score line 39 joining manufacture's flap 20 to its corresponding sidewall panel 18. A series of first flange panels 40, 42, 44 and 46 is foldably secured to their respective sidewall panels through fold or score lines 36, and score line 48 is at the top of each first flange panel. Score line 49 is parallel to score 48. A series of second flange panels 54, 56, 58 and 60 is located at the top edges of respective first flange panels. A tongue 62 is foldably secured to second flange panel 60, tongue 62 having a right hand free edge. The numeral 64 denotes generally the left edge of the blank and this is termed a free edge. Similarly, the numeral 66 denotes the right side of the blank and is also a free edge, except for manufacture's flap 20 and tongue 62. Top forming panels 70, 72, 74 and 76 are positioned on the top edge of their respective second flange panels by virtue of score or fold line 80.

The numeral 82 denotes generally a conventional flexible tape which is preferably pressure sensitive and is reinforced itself by means of longitudinally extending threads. Reinforcing tape 82 commences at the right hand or free edge of tongue 62 and is adhesively affixed to the second flange panels and extends to the free edge 64 of the blank, i.e., the left free edge of second flange panel 54.

Figure 5:
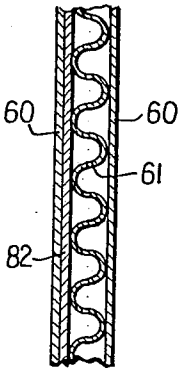
FIG. 5 is a partial view of the preferred manner of affixing the reinforcing band to a blank of corrugated paperboard.

For purposes of illustration and clarity of explanation, the tape 82 is shown in FIGS. 1 to 4 as positioned on one surface of the blank, on the second flange panels, and the paperboard is shown as being of a single layer in FIGS. 3 and 4. In the preferred form of the invention, however, the paperboard is of the usual three component type. Namely, two facers or liners sandwich and are glued to a corrugating medium. Further, the tape 82 is placed directly on one side of the corrugating medium and one of the lines placed over it, with the tape being glued to the corrugating medium and to its overlying liner or otherwise fixed in this location. This preferred mode of the invention is illustrated at FIG. 5. FIG. 5 may be considered as a cross sectional view similar to FIG. 4. The liners are denoted by the numeral 60 (being the second flange panel) and the corrugating medium by 61 and the reinforcing tape 82 is seen to be between the corrugating medium and one of the liners. The extent of the tape 82 is the same as shown at FIG. 1.

Except for the reinforcing tape 82 and the relative location of its manufacture's flap, the blank of FIG. 1 is similar to the blank illustrated in FIG. 8 of the above noted Guyer patent.

The carton is formed from the blank in the following manner. Manufacturer's flap 20 is provided with glue and is secured to a corresponding portion of the left or free edge of side panel 12, as indicated at FIG. 3 of the drawings, with folding of the blank into a tube like structure taking place along vertically disposed fold lines 38 and the fold lines between the second flange panels. Facing surfaces of the first and second flange panels are provided with adhesive, indicated by stippling 78 and is shown at FIG. 4, and, typically at the same time, tongue 62 is inserted and glued between the left hand edges of flange panels 40 and 54 (referring to FIG. 1) as may be seen by reference to FIG. 3. The right hand end of tape 82 thus overlaps the left hand end, separated by the thickness of tongue 62, as may be seen in FIG. 3. Neither the bottom nor the top closure having been formed, the tube is in a collapsed configuration and may be stored until such time as its use as a carton is required. At such time, the collapsed tube is squared up, one of the ends closed, the carton is filled and the other closure panel also closed.

In FIG. 2, the reader may imagine the bottom closure panels to have been first closed, the carton having been filled and the top closure panels having been partially closed. The blade of a typical lift truck is indicated in phantom lines at FIG. 4 and it is seen that the blade extends, as is conventional, between the outside surface of a side wall, here side wall 18, and the regularly innermost flange panel, being there shown as first flange panel 46.

The reinforcing tape 82, having been completely installed prior to filling of the carton, thus yields a greater antibulging effect than does a top lifting carton whose flanges are only reinforced after loading or filling of the carton, as with the Powlenko construction.

The reinforcing tape 82 has been illustrated as positioned on (FIG. 4) or partially within (FIG. 5) the second flange panels. While this is a preferred form of the invention, the tape could be located on the first flange panels, with tongue 62 relocated to the right or free end of first flange panel 46. The shown slots between the several first flange panels could be either retained or eliminated.

With further reference to the Guyer construction, a tab 37, corresponding to the tab 62 of this invention, is also carried by a member comparable to the second flange panel 60 of the present invention. However, tongue 37 of the Guyer construction is glued to the outside of an adjacent radially outermost flange panel and is thus more prone to accidental tearing away or ripping away than the present construction wherein the tongue is located completely between the first and second flange panels. By locating the tongue 62 between the first and second flange panels and gluing it there, the reinforcing tape 82 is effectively annularly continuous.

The terms upper and lower are employed in the claims as an aid in their understanding and are not intended to be terms of limitation.

What is claimed is:

1. A tube type top lifting carton formed from a unitary blank of paperboard, said carton having a plurality of sidewalls each having an upper edge, the upper edge of each sidewall carrying an integral flap foldably secured thereto, each flap having a first flange panel of uniform width and folded substantially 180 degrees from the upper edge of the respective sidewall and lying substantially parallel to an outer surface of its respective side wall, to thereby define a lift truck blade receiving recess, each first flange panel foldably secured to a second flange panel of uniform width secured to a lower edge of said first flange panel and lying on a radially outermost surface of said first flange panel, each flap having a top closure forming panel foldably secured to said second flange panel, said top forming panels being horizontally disposed to form a top closure for said carton and being folded substantially 90 degrees from an upper edge of said second flange panel, one end of one of said flange panels integrally carrying a tongue which extends from said one flange panel end to a zone between the first and second flange panels of a next adjacent sidewall, whereby said tongue is sandwiched by portions of said first and second flange panels of said next adjacent sidewall, a flexible reinforcing strip extending from a free end of said tongue, said reinforcing strip positioned between said first and second flange panels, ends of said reinforcing strip being overlapped and separated by the thickness of said tongue to thereby form a substantially continuous reinforcing member of greater than 360 degrees annular extent, lower edges of said sidewalls carrying means for forming a bottom, whereby outward bowing of said first and second flange panels is lessened when fingers of a fork lift truck are inserted between any sidewalls and its respective first flange panel for lifting the carton when the carton is filled.

2. The carton of claim 1 wherein said reinforcing strip is carried by said tongue and one series of said first and second series of flange panels.

3. The carton of claim 1 wherein said first and second flange panels are glued together at facing surface thereof.

4. The carton of claim 1 wherein said reinforcing strip is positioned contiguous to the fold between the first and second flange panels of each said sidewall.

5. The carton of claim 1 wherein said reinforcing strip is carried by said second flange panels and said tongue is carried by one of said second flange panels.

6. The carton of claim 1 wherein said paperboard is corrugated paperboard having liners and corrugating medium and wherein said reinforcing strip is located between one of the liners and the corrugating medium of the paperboard.

7. A generally rectangular blank and reinforcing strip construction for forming a tube type, top lifting carton, said blank being of a one-piece construction and formed of paperboard and having a plurality of generally rectangular sidewall and flange panel forming panels defined by a plurality of spaced and parallel vertically and horizontally disposed fold lines, each sidewall panel carrying means at a lower end for forming a carton bottom, each sidewall panel having an upper end defined by a horizontally disposed fold line, a first of said flange panels foldably secured to an upper edge of each sidewall panel to define a series of first flange panels, a second flange panel foldably secured to an upper edge of a respective first flange panel to form a series of second flange panels, said first and second flange panels being of equal width, a top closure forming panel foldably secured to an upper edge of a respective second flange panel, two side edges of said first and second flange panels not being connected to any other panel and termed free flange panel side edges, one of said free side edges having a horizontally extending tongue extending beyond said one free edge, a flexible reinforcing tape continuously extending across said tongue to said other flange panel free edge, said tape fixed to one of said first and second series of second flange panels.

8. The blank of claim 7 wherein said reinforcing tape is of a lesser width than that of said flange panels.

9. The blank of claim 8 wherein said reinforcing tape is positioned on said second flange panel nearer to said first flange panels than to said top closure panels.

10. The blank of claim 7 wherein said paperboard is corrugated paperboard having liners and corrugating medium and wherein said reinforcing strip is located between one of the liners and the corrugating medium of the paperboard.

11. The blank of claim 7 wherein said reinforcing tape is carried by said second flange panels and wherein said tongue is located at the free end of one of said second flange panels.

* * * * *